US005282395A

United States Patent [19]

LaPointe et al.

[11] Patent Number: 5,282,395

[45] Date of Patent: Feb. 1, 1994

[54] RECLINER HANDLE

[75] Inventors: Larry P. LaPointe, Temperance; Karl J. Komorowski, Petersburg, both of Mich.

[73] Assignee: La-Z-Boy Chair Co., Monroe, Mich.

[21] Appl. No.: 6,176

[22] Filed: Jan. 15, 1993

Related U.S. Application Data

[63] Continuation of Ser. No. 794,454, Nov. 19, 1991, abandoned.

[51] Int. Cl.[5] ..... G05G 1/04

[52] U.S. Cl. ..... 74/523; 74/548; 74/543; 297/362; 403/362

[58] Field of Search ..... 74/522, 523, 524, 529, 74/543, 548, 473 R, 545; 297/367, 355, 362, 378; 403/383, 359, 362, 361; 16/114 R, 111 R, 112, DIG. 12, DIG. 19, DIG. 24

[56] References Cited

U.S. PATENT DOCUMENTS

| | | | |
|---|---|---|---|
| 951,836 | 3/1910 | Noack | 403/362 |
| 2,117,947 | 5/1938 | De Rome et al. | 403/383 |
| 2,311,821 | 2/1943 | Floraday | 74/545 |
| 2,463,066 | 3/1949 | Stuvel | 403/362 |
| 2,607,616 | 8/1952 | Davidson | 403/361 |
| 2,733,942 | 2/1956 | Palmer | 403/383 |
| 2,784,770 | 3/1957 | Herr | 297/367 |
| 2,893,724 | 7/1959 | Kales et al. | 403/362 |
| 3,096,121 | 7/1963 | Knabusch et al. . | |
| 3,250,148 | 5/1966 | Soles | 74/548 |
| 3,383,944 | 5/1968 | Skinner | 74/543 |
| 3,400,446 | 9/1968 | Yulkowski | 29/463 |
| 3,904,240 | 9/1975 | Rogers, Jr. et al. . | |
| 4,072,342 | 2/1978 | Johnson et al. . | |
| 4,343,502 | 8/1982 | Nelson | 74/548 |
| 4,367,895 | 1/1983 | Pacitti et al. . | |
| 4,781,416 | 11/1988 | Johnson et al. | 297/362 |

FOREIGN PATENT DOCUMENTS

| | | | |
|---|---|---|---|
| 2216823 | 10/1973 | Fed. Rep. of Germany . | |
| 0727445 | 3/1955 | United Kingdom | 297/378 |

*Primary Examiner*—Carl D. Friedman
*Assistant Examiner*—Winnie Yip
*Attorney, Agent, or Firm*—Harness, Dickey & Pierce

[57] ABSTRACT

A detachable manual actuation handle for a recliner chair having a square-shaped drive rod. The handle comprises a metal insert having a star-shaped bore for receiving the free end of the drive rod in a plurality of alternate angular orientations. The star-shaped bore is configured such that a locking means, in the form of a threaded bore and set screw that are perpendicular to the star-shaped bore, is adapted to provide, at an acute angle, a locking force against the flat surface of the drive rod to retain the handle thereon.

4 Claims, 2 Drawing Sheets

PRIOR
ART

FIG 5
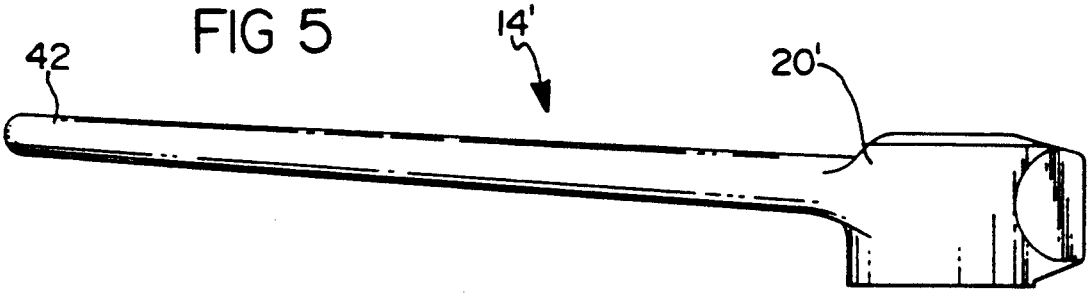
FIG 3
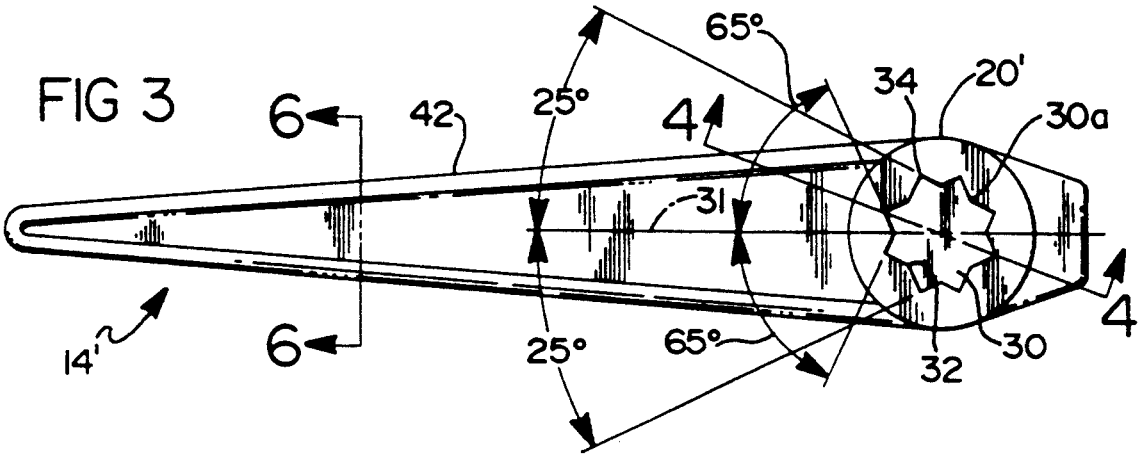
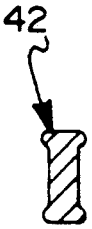
FIG 6
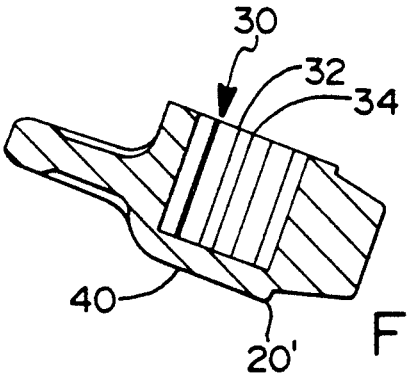
FIG 4
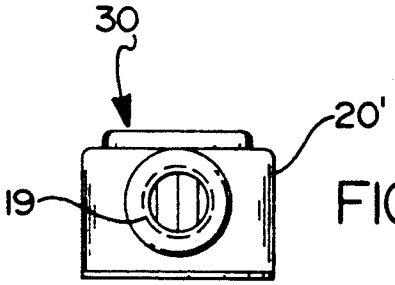
FIG 7
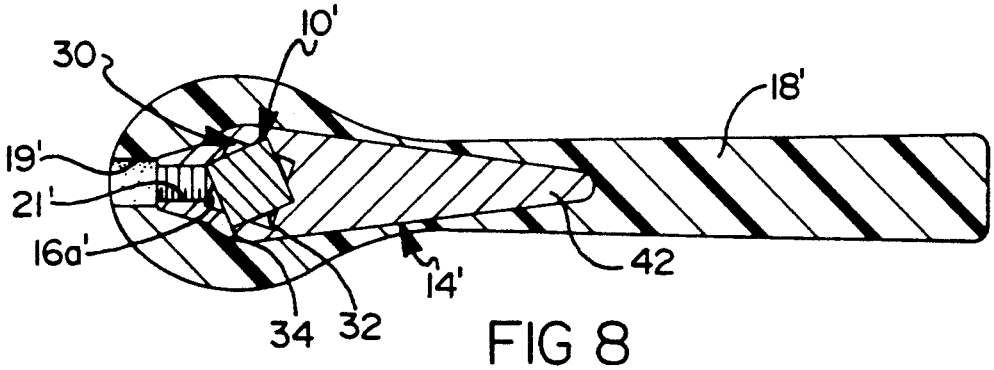
FIG 8

RECLINER HANDLE

This is a continuation of U.S. patent application Ser. No. 07/794,454, filed Nov. 19, 1991, now abandoned entitled RECLINER HANDLE.

BACKGROUND OF THE INVENTION

This invention is directed to a lever handle for attaching to a rotatable drive rod, and more specifically to a lever handle disposed on the exterior of a recliner-type chair where the handle is used to control various features and mechanisms of the recliner chair.

Recliner chairs come in a variety of shapes and sizes. For example, some chairs have a rocking mechanism, some chairs have extendible footrests, while other chairs have seats and seat backs that move from a normal upright position to a reclined forward position. While a given recliner chair can possess any one or all of these features, almost all recliner chairs share in common the need to provide for a handle or lever by which the user can select and control various chair positions and mechanisms. The recliner handle, because it must be easily accessible by the user, is typically located along the lower lateral portion of the chair below the armrest.

In operation, the recliner handle has several constraints. First, the handle should be durable enough to sustain extended periods of use without breaking, bending or loosening. It is also desirable to have a single universal handle that could be mounted on the left side of chair for actuation by a left-handed person or could be mounted on the right side of the chair for actuation by a right-handed person without performing specialized manufacturing steps to the chair itself. Similarly, it is desirable that the handle be suitable for mounting on more than one style of chair for operation of its associated mechanisms. Finally, it is desirable that the handle be capable of being attached to a variety of chair mechanisms in a variety of orientations, without having to adhere to unduly restrictive manufacturing tolerances.

SUMMARY OF THE INVENTION

It is therefore an object of the present invention to provide an improved lever handle for engaging a drive rod of a recliner chair wherein the drive rod is rotated to operate a mechanism associated with the recliner chair such as a retractable footrest mechanism or the like. The lever handle includes a generally oblong body having an enlarged end and a narrow end suitable for grasping, and an insert disposed within the enlarged end for detachably securing the handle to the drive rod. The insert comprises a collar portion having a star-shaped bore and a locking means in the form of a set screw and corresponding threaded bore located in a boss on the collar. The threaded bore is radially aligned on the collar perpendicular to the star-shaped bore. The insert also comprises a tang portion which extends radially from the collar portion and extends into the portion of the handle body suitable for grasping such that the tang reinforces the handle and prevents the collar from rotating within the body. The insert is capable of receiving and engaging the drive rod such that the handle can be oriented with respect to the drive rod in a variety of radially extending directions. The star-shaped bore of the insert is configured such that the set screw engages the drive rod at an acute angle to the flat surface of the drive rod thereby ensuring that the handle is securely mounted to the recliner chair.

BRIEF DESCRIPTION OF THE DRAWINGS

The foregoing description of the presently preferred embodiment can be better understood by referencing the accompanying drawings in which:

FIG. 3 is a plan view of the insert of FIG. 2;

FIG. 4 is a sectional view taken along lines 4—4 of FIG. 3;

FIG. 5 is a side elevation of the insert of FIG. 3;

FIG. 6 is a sectional view taken along lines 6—6 of FIG. 4; and

FIG. 7 is an end view of the insert of FIG. 3.

FIG. 8 is a cross sectional view of the handle of the apparatus of FIG. 2 showing the insert member molded within the lever handle.

DESCRIPTION OF THE PREFERRED EMBODIMENT

The preferred embodiment of the present invention is directed toward a universal lever handle for use on recliner-type chairs. These recliner-type chairs typically have mechanisms for, among other things, extending and retracting a footrest, reclining and returning the seat back to an upright position, and/or operating various lock out mechanisms which may permit or prevent the chair body from traveling along a track toward a tilted position, or permit or prevent the chair body from rocking. Many recliner chairs with such mechanisms include a drive rod to which a mechanism actuation handle is attached. By sitting in the chair and rotating the handle clockwise or counterclockwise, the user can operate one or more of the chair mechanisms. An example of a recliner chair incorporating various of such mechanisms and an associated drive rod is set forth in application Ser. No. 07/772,231, filed Oct. 11, 1991, entitled Modular Reclining Chair and Method, and owned by the assignee of the present invention. Another example of such a recliner chair is set forth in application Ser. No. 07/740,980, filed Aug. 6, 1991, entitled Reclining Sofa, and owned by the assignee of the present invention. Due to the well known nature of such types of recliner chairs and/or sofas the associated mechanisms and drive rod will not be described in detail herein except to the extent necessary to provide an understanding of the present invention.

Figure 1:
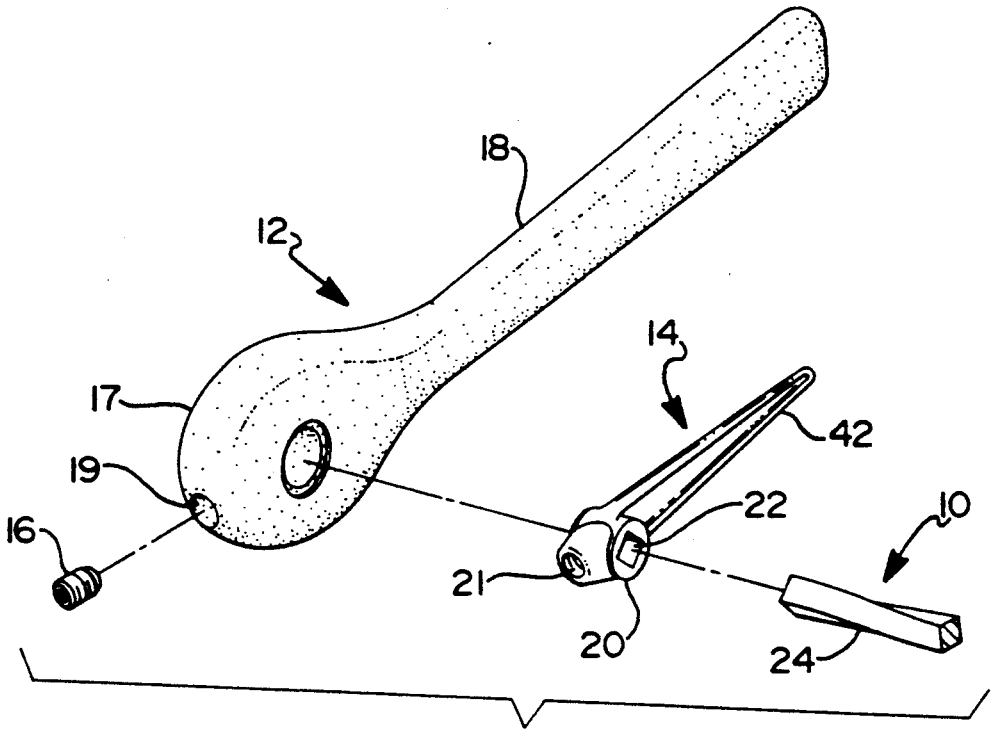
FIG. 1 is an exploded view perspective of a prior art handle and drive rod.

As can be better understood by referencing FIG. 1, a drive rod 10 typically comprises a square steel shaft. Prior known lever handles, generally indicated at 12, typically have an enlarged end 17 and a narrow end 18 and are attached to the drive rod by way of an included insert 14 and locking means in the form of a set screw 16. A collar portion 20 of the insert 14 includes a threaded bore 21. In operation, the insert 14 is molded within the handle 12 so that only the collar portion 20 and set screw (i.e., access) bore 19 of the insert 14 are accessible. The handle 12 is attached to the drive rod 10 by inserting the protruding end of the drive rod 10 into a square shaped bore 22 within the insert 14, and set screw 16 is tightened against a corner of the square drive rod to secure the handle 10 to the chair.

However, the square shaped bore 22 of insert 14 creates certain deficiencies for a recliner chair. It has been found that orientation of a recliner chair actuation handle in a position in which the narrow portion or free end of the handle is canted slightly towards the occupant from horizontal is desirable. Such an orientation affords the greatest amount of torque created by the occupant when pulling the free end of the handle upwardly to operate the particular mechanism to which the drive rod 10 is connected. For example, to operate one of the chair mechanisms such as the footrest mechanism, the handle is pulled upwardly by the occupant in order to rotate the drive rod and extend the pantograph linkage to which the footrest is attached. However, typically there are a multiplicity of links and other footrest mechanism components which are attached to the drive rod internally of the chair. These links and components are often utilized in sets, e.g., one link associated with the left footrest pantograph and a mirror image of that link associated with the other, i.e., right, footrest pantograph. In order to decrease the individual number of differently configured chair mechanism parts, and therefore the tooling, manufacturing, inventory, and assembly costs associated therewith, it is highly desirable to utilize as many universal or non-directional parts as possible. With respect to a recliner chair's extendable footrest, or other similar drive rod actuated mechanism, a link or component thereof is universal when it can be used on one side of the mechanism and simply flipped over and used as the same required part on the other side of the mechanism. In order to make such a part universal, the square-shaped aperture which is provided for sliding the part onto the drive rod must be symmetrically angularly orientated with respect to any protruding feature or portion of the component. In this manner, whether the part is placed on the left side of the drive rod or flipped over and placed on the right side of the drive rod the protruding feature or portion of the part will be identically angularly oriented. As such, the particular angular orientation of the parts required for connection to and operation with other associated components of the mechanism invariably requires an angular orientation of the drive rod that does not place the handle 12 in the desired orientation upon attachment to the drive rod. Accordingly, in an effort to solve this deficiency a special manufacturing step is performed wherein the end of the drive rod 10 that protrudes outwardly from the side of the chair is rotated relative to the remainder of the drive rod an amount sufficient to provide the desired orientation of the handle 12. This step is illustrated in FIG. 1 where it can be noticed that a portion of drive rod 10 has been angularly rotated or twisted (designated as twist 24). This twist 24 is necessary to insure that the handle 12 will be oriented at the desired attitude once it is attached to the drive rod 10. However, the twist 24 that is imparted to the end of the drive rod is particular to the side of the chair from which the drive rod protrudes. In other words, the appropriate twist to properly orient a right hand handle 12 is not the same twist that is necessary to properly orient a left hand handle on the same chair. The protruding end of the drive rod for a chair having a handle 12 on its left side requires a counterclockwise twist while the protruding end of a drive rod for a chair having a handle 12 on its right side requires a clockwise twist. Accordingly, such drive rods 10 are not interchangeable and it is necessary to custom manufacture the drive rod depending on which side of the chair the handle will be placed. This is undesirable in that it requires additional manufacturing operations and prevents a universal drive rod from being used on the particular type of chair manufactured regardless of whether it is fitted with a right or left hand handle.

Furthermore, if the drive rod 10 is slightly out of square the handle 12 has a tendency to become undesirably loose after a relatively short period of usage. In handles having the prior known insert 14, the set screw 16 impacts against a corner of the square drive rod 10 (which may or may not have been provided with a "flat" to more easily accommodate the set screw) and forces the opposite cross sectional corner of the drive rod 10 into the corner of the insert opposite the threaded bore 19. When the angle of that opposite corner of the drive rod is smaller than the angle of the insert corner into which it is forced, due to manufacturing tolerances or the like, a rocking action may occur between the handle 12 and the drive rod 10 as the handle is operated. This "play" is undesirable as it is aesthetically objectionable and may cause the set screw 19 to loosen and the handle 12 to come off.

The present invention is directed to an improved universal manual actuation handle 12' which includes an insert 14' having a generally star-shaped bore 30 which not only obviates the need for twisting the end of the drive shaft 10' for proper handle orientation but also enables the handle 12' to be more securely mounted to the drive shaft 10'.

Figure 2:
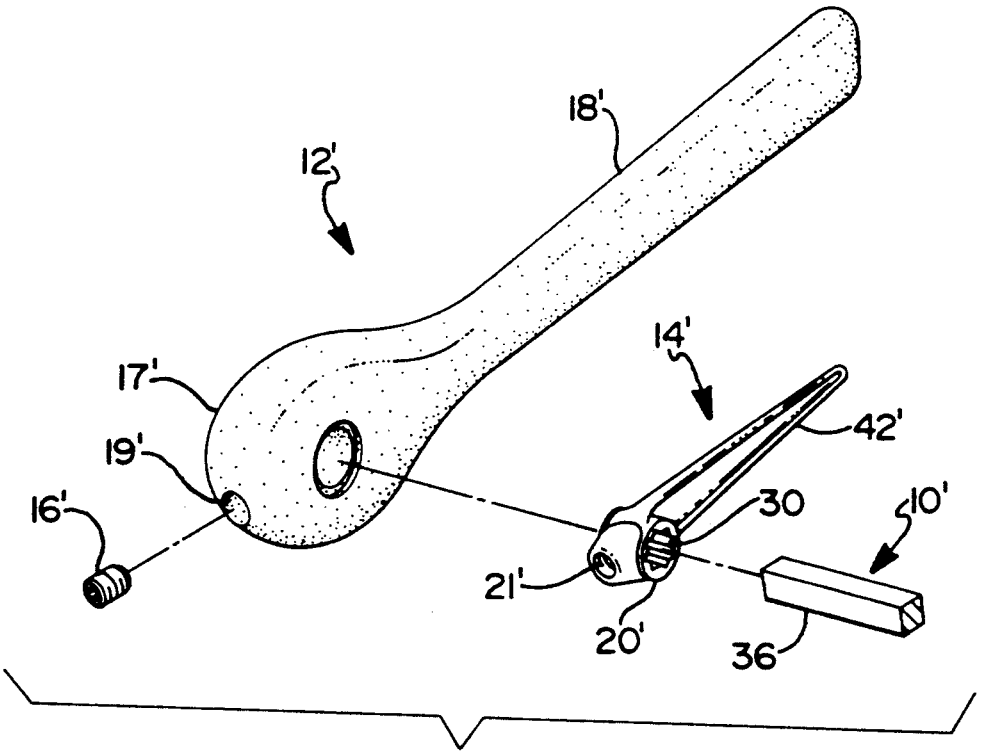
FIG. 2 is an exploded view perspective of the presently preferred handle and insert assembly.

As can be appreciated by referring to FIG. 2, the star-shaped bore 30 comprises additional corners or angles within the insert 14' for receiving the square drive rod 10' and thereby obviates the need for twisting the drive rod 10'. This is advantageous, as it allows the handle 12' to be mounted to the drive rod 10' at the desired orientation despite the fact that the particular square apertures in various of the mechanism links and components attached to the drive rod require that the drive rod 10' be oriented at a different angulation offset. Due to the particular configuration of the star-shaped bore 30, the handle 12' can be universally mounted on drive shafts 10' for many different mechanisms regardless of whether the mechanism is left-handed or right-handed and regardless of whether the particular mechanism requires that the drive rod be angularly offset clockwise or counterclockwise.

The advantages of the star-shaped bore 30 can be better appreciated by referring to FIG. 3. The handle insert 14' has a non-uniform eight-pointed (sixteen sided) star-shaped bore 30 extending substantially through the collar portion 20' of the insert 14'. The star-shaped bore 30 is configured such that the insert 14' and thus handle 12' can be easily attached to the square drive rod 10' regardless of whether the drive rod 10' is rotated slightly in a clockwise or counterclockwise direction. The star-shaped bore 30 has a series of valleys or inwardly extending corners 32 which are located between adjacent peaks or outwardly extending corners 34 of the star-shaped bore. As shown in FIG. 3, one set of outwardly extending corners, 34 that form a square cross section for receiving the drive rod 10' is oriented at an angle of approximately 65° above (or 25° below) the longitudinal centerline 31 of insert 14'. The other set of outwardly extending corners 34 which form a square cross section for receiving the drive rod 10' is orientated at an angle of approximately 25° above (or 65° below) the same center line 31. In this manner when the handle 12' with its insert 14' is placed over the end of the square drive rod 10', not only does the handle 12' attain the desired orientation, but the set screw 16' also engages a flat surface 36 of the drive rod 10' at approximately a 65° angle. Thus, when the set screw 16' is tightened against the drive rod 10' at an acute angle, the drive rod 10' is urged laterally of the set screw 16' into wedging engagement with a plurality of the outwardly extending corners 34, as is apparent from the drawing of FIG. 8, while the set screw 16' tends to be urged laterally of the drive rod 10' thus tending to help secure the set screw 16' even more securely within the threaded bore 21' to resist loosening. The handle 12' can thus be more securely attached to the drive rod 10' and will not have a tendency to loosen as with the prior design. This increased tightness is achieved despite the presence of manufacturing tolerances. In handle 12', since the set screw 16' tightens at an angle to the flat surfaces 36 compensation is automatically made for any wear or out-of-square condition. Similarly, since the size of the drive rod 10' is somewhat smaller than that of the star shaped bore 30 due to desired clearances or manufacturing tolerances, the set screw 16' tightening against the flat surfaces 36 of the drive rod 10' at an angle forces the drive rod in one direction, removing substantially all tolerances, and securely locks the drive rod 10' in that direction. Preferably, the set screw 16' is a ⅜" screw, compared to prior set screws 16 being 5/16" in diameter, which also enhances the ability of handle 12' to be more securely tightened.

As shown in FIG. 4, the star shaped bore 30 extends most of the way through the collar portion 20'. Collar portion 20' further includes a threaded bore 21' through which the set screw 16' threadably extends. Since the insert 14' is preferably comprised of a durable metal, the backing portion 40 of the collar 20' provides a surface against which the end of the drive rod 10' can contact.

As can be seen in FIGS. 3 and 5, the insert 14', similar to the prior known insert 14, includes a tang portion 42' which extends axially from the collar 20'. The tang 42' extends substantially along the narrow portion 18' of the handle 12' to provide strength and resiliency. More particularly, the tang 42' prevents the collar 20' from rotating within the handle 12', as well as providing additional strength to the handle 12' so that the handle is better able to accommodate the torque introduced to it when the chair occupant grasps the handle to rotate it for manually actuating one or more of the chair mechanisms. While the tang 42' has a generally triangular appearance, as can be seen in FIG. 6 its cross-sectional appearance is configured for both longitudinal and lateral strength properties. Similar to prior insert 14, the set screw of 16' of insert 14' is received in the collar 20' through an access bore 19 located opposite the tang 42' and extending radially through a threaded aperture 21' in the collar 20' where it intersects the star-shaped bore 30.

It is to be understood that although the body 18' of handle 14' is generally shown in the Figures herein to have a particular configuration, alternate configurations such as an elongated triangular shape or others suitable to incorporate insert 14' within could also be utilized. Similarly, handles 12' may have the narrow gap portion of body 18' lengthened or shortened to respectively increase or decrease for different chair applications the amount of torque generated by the chair occupant when the handle is rotated. Furthermore, while body 18' is preferably constructed of a suitable plastic or other resin material and insert 14' is preferably constructed of metal, other suitable materials such as wood for the body or high-strength reinforced plastic for the insert may also be utilized. Still further, it is contemplated that handle 12' can be constructed of a single material that comprises a body 18' having a star-shaped bore 30 and locking means formed therein.

The foregoing description of the presently preferred embodiment has been provided for the purposes of illustration. It will be appreciated by one of ordinary skill in the art that still other modifications could be made without departing from the spirit or scope of this invention as set forth in the appended claims.

We claim:

1. An apparatus for initiating reclining and returning movement of a portion of a recliner chair, comprising:

a drive rod having a plurality of planar surfaces extending parallel to each other which is not angularly twisted;

a lever handle including a generally oblong body having an enlarged end and a narrow end suitable for grasping, said enlarged end including an access bore;

an insert member having an octagonally-pointed bore provided perpendicular to the longitudinal axis of said handle and including a threaded bore extending through a portion thereof and opening into said octagonally-pointed bore, said octagonally-pointed bore having a plurality of inwardly extending corners and a plurality of outwardly extending corners and being operable to receive a free end of said drive rod in a plurality of angular orientations;

a set screw threadably insertable into said threaded bore, said set screw having a bevelled corner;

said octagonally-pointed bore being positioned within said insert member such that a centerline extending longitudinally through said insert member and said threaded bore extends through said inwardly extending corners of said octagonally-pointed bore spaced approximately 180° from each other so that when said handle is detachably secured to said drive rod, said bevelled corner of said set screw is tightened against a flat surface of said drive rod at an acute angle, said acute angle being approximately 65°, to cause said drive rod to be wedged laterally of said set screw such that at least one corner of said drive rod is wedged into at least one of said outwardly extending corners of said octagonally-shaped bore, and said bevelled corner of said set screw is urged laterally of said drive rod to help secure said set screw in said threaded bore such that said set screw is resistant to loosening in said threaded bore; and said insert member further having a tang portion, said insert member being molded within said lever handle body such that said tang portion is encapsulated within said narrow end of said lever handle body.

2. An apparatus for initiating reclining and returning movement of a portion of a recliner chair comprising:

a drive rod having a plurality of flat surfaces extending parallel to each other so as not to be twisted;

a lever handle including a generally oblong body having an enlarged end and a narrow end suitable for grasping, said enlarged end having an access bore;

an insert member molded within said oblong body to form an integral, single-piece lever handle, said insert member being disposed substantially within said enlarged end of said oblong body, for detachably securing said lever handle to said drive rod;

said insert member including a collar portion having an octagonally-pointed bore for receiving a free end of said drive rod in a multiplicity of angular orientations and a threaded bore extending generally perpendicularly to said octagonally-pointed bore, said threaded bore further being longitudinally aligned with said access bore of said oblong body, said octagonally-pointed bore having a plurality of inwardly extending corners and a plurality of outwardly extending corners;

a tang portion which extends radially within said body from said collar portion of said insert member into said narrow end of said oblong body such that said tang portion prevents rotation of said collar portion within said body;

a set screw having a bevelled corner, said set screw extending through said access bore of said oblong body and extending threadably through said threaded bore in said collar portion, and into said octagonally-pointed bore;

wherein said lever handle is adapted to be securely attached to either terminal end of said drive rod in a plurality of radially extending directions via engagement of said drive rod within said octagonally-pointed bore and engagement of said set screw against said drive rod; and said octagonally-pointed bore being configured such that a centerline extending longitudinally through said insert member and said threaded bore extends through inwardly extending corners of said octagonally-pointed bore spaced approximately 180° from each other so that when said handle is detachably secured to said drive rod said bevelled corner of said set screw is tightened against a flat surface of said drive rod at an acute angle, said acute angle being approximately 65°, to cause said drive rod to be wedged laterally of said set screw such that at least one corner of said drive rod is wedged into at least one of said outwardly extending corners of said octagonally-pointed bore, and said bevelled corner of said set screw is urged laterally of said drive rod to help secure said set screw in said threaded bore such that said set screw is resistant to loosening in said threaded bore.

3. The apparatus as set forth in claim 2 wherein said insert member is comprised of metal and said body is comprised of a plastic material which is molded substantially around said insert.

4. An apparatus for initiating reclining and returning movement of a portion of a recliner chair comprising:

a drive rod having a plurality of flat surfaces extending parallel to each other so as not to be twisted;

a lever handle including a generally oblong body having an enlarged end and a narrow end suitable for grasping, said enlarged end having an access bore;

an insert member molded within said oblong body to form an integral, single-piece lever handle, said insert member being disposed substantially within said enlarged end of said oblong body for detachably securing said lever handle to said drive rod;

said insert member including a collar portion having an octagonally-pointed bore formed therein for receiving a free end of said drive rod in a plurality of angular orientations, and a threaded bore extending generally perpendicularly to said octagonally-pointed bore and opening into said octagonally-pointed bore, said threaded bore further being longitudinally aligned with said access bore of said oblong body;

a set screw having a bevelled corner, said set screw extending through said access bore of said oblong body and threadably through said threaded bore in said collar portion and into said octagonally-pointed bore, said bevelled corner of said set screw abuttingly engaging a portion of said drive rod when said lever handle is placed on said end portion of said drive rod and said set screw is threadably engaged in said threaded bore; and said octagonally-pointed bore being configured such that a centerline extending longitudinally through said insert member and said threaded bore extends through inwardly extending corners of said octagonally-pointed bore spaced approximately 180° from each other so that when said lever handle is detachably secured to said drive rod said bevelled corner of said set screw is tightened against a flat surface of said drive rod at an acute angle relative to said flat surface of said drive rod to cause said drive rod to be urged laterally of said set screw into at least one corner of said octagonally-pointed bore, said set screw being simultaneously wedged laterally of said drive rod to cause said set screw to resist loosening in said threaded bore.

* * * * *

UNITED STATES PATENT AND TRADEMARK OFFICE

CERTIFICATE OF CORRECTION

PATENT NO. : 5,282,395
DATED : February 1, 1994
INVENTOR(S) : Larry P. LaPointe, et. al.

It is certified that error appears in the above-indentified patent and that said Letters Patent is hereby corrected as shown below:

Column 4, line 58, after "bore" insert --30--.

Column 5, line 1, after "but" insert --a bevelled corner 16' of--.

Column 5, line 51, delete "of" (first occurrence)--.

Signed and Sealed this

Nineteenth Day of July, 1994

*Attest:*

*Attesting Officer*

Bruce Lehman

BRUCE LEHMAN

*Commissioner of Patents and Trademarks*